US007654577B2

(12) United States Patent
Glosh et al.

(10) Patent No.: US 7,654,577 B2
(45) Date of Patent: Feb. 2, 2010

(54) NOTEPAD SYSTEM FOR HOLDING AND DISPENSING VARIOUS SIZED NOTEPADS

(75) Inventors: Amy Elizabeth Glosh, Kettering, OH (US); Jill Marie Broering, Troy, OH (US)

(73) Assignee: MeadWestvaco Corporation, Richmond, VA (US)

( * ) Notice: Subject to any disclaimer, the term of this patent is extended or adjusted under 35 U.S.C. 154(b) by 138 days.

(21) Appl. No.: 11/286,663

(22) Filed: Nov. 23, 2005

(65) Prior Publication Data

US 2007/0114781 A1 May 24, 2007

(51) Int. Cl.
*B42D 3/18* (2006.01)
*B42D 3/12* (2006.01)

(52) U.S. Cl. ..... 281/44; 281/31

(58) Field of Classification Search ..... 434/108; 402/70, 4, 73; 283/38, 83; 281/15.1, 37, 281/29, 31, 44, 51

See application file for complete search history.

(56) References Cited

U.S. PATENT DOCUMENTS

| | | | | |
|---|---|---|---|---|
| 2,161,015 | A * | 6/1939 | Buxton | 281/17 |
| 3,685,170 | A * | 8/1972 | Fairleigh | 434/248 |
| 4,105,224 | A * | 8/1978 | Rodebaugh et al. | 281/15.1 |
| 4,575,126 | A * | 3/1986 | Grubbs | 283/38 |
| 4,890,728 | A * | 1/1990 | Grimsley | |
| 4,932,520 | A * | 6/1990 | Ciarcia et al. | 206/232 |
| 4,973,184 | A | 11/1990 | La Salle | |
| 5,119,574 | A * | 6/1992 | King | 40/537 |
| 5,294,208 | A * | 3/1994 | Tremmel et al. | 402/70 |
| 5,360,234 | A * | 11/1994 | Miller et al. | 281/31 |
| 5,443,387 | A * | 8/1995 | Mortemard de Boisse | 434/108 |
| 5,618,033 | A * | 4/1997 | Owen et al. | 271/1 |
| 5,713,684 | A | 2/1998 | Turecamo | |
| 6,017,062 | A | 1/2000 | White | |
| 6,045,160 | A | 4/2000 | Weeks | |
| 6,202,839 | B1 * | 3/2001 | Petersen et al. | 206/308.1 |
| 6,312,183 | B1 | 11/2001 | Arnold | |
| 7,096,544 | B2 * | 8/2006 | Lusardi | 24/306 |
| 2001/0000480 | A1 * | 4/2001 | Stagg et al. | 428/43 |

OTHER PUBLICATIONS

Photographs (4 color) and web page printout of Lotta Jansdotter Sticky Notes (Spring 2004).

* cited by examiner

*Primary Examiner*—Dana Ross
*Assistant Examiner*—Pradeep C Battula
(74) *Attorney, Agent, or Firm*—Steve Elleman; Alison R. Scheidler; Donald G. Bauer

(57) ABSTRACT

A notepad system includes a piece of generally flat backing material, and a plurality of generally rectangular notepads removably mounted to the piece of backing material. The plurality of notepads are located immediately adjacent to each other and define a recognizable shape.

23 Claims, 7 Drawing Sheets

NOTEPAD SYSTEM FOR HOLDING AND DISPENSING VARIOUS SIZED NOTEPADS

BACKGROUND

The present invention is directed to a notepad system, and more particularly, to a notepad system for holding and dispensing various sized notepads.

Notepads are widely used to dispense sheet-like papers upon which reminders, notes, etc. can be written. Such notepads may be mounted to a backing sheet or notepad dispenser. However, most existing devices for holding and dispensing notepads do not provide a compact nesting arrangement. Furthermore, most existing devices are configured to receive notepads thereon in only a single configuration.

Accordingly, there is a need for a compact nesting arrangement for notepads, as well as a supporting means for receiving various sized notepads or writing tablets.

SUMMARY

In one aspect, the invention is a notepad system including a piece of generally flat backing material, and a plurality of generally rectangular notepads removably mounted to the piece of backing material. The plurality of notepads are located immediately adjacent to each other and define a recognizable shape.

Other aspects of the invention will become apparent from the following description, the accompanying drawings and the appended claims.

DETAILED DESCRIPTION

Figure 1:
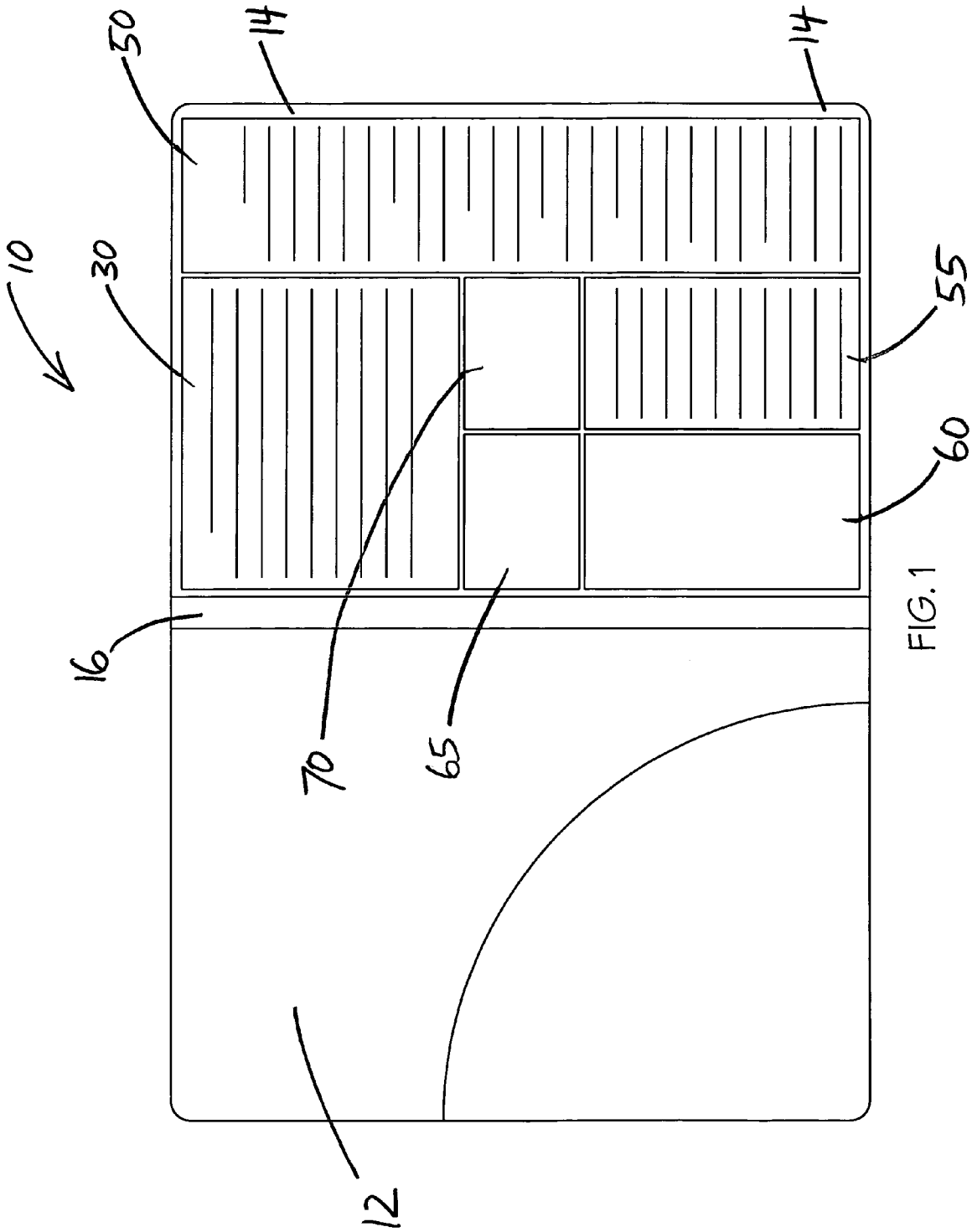
FIG. 1 is a top view of one embodiment of the notepad system of the present invention, showing notepads of various sizes mounted on the backing panel.

In one embodiment of the invention, as shown in FIGS. 1-5, a notepad system, generally designated 10, includes a piece of flat backing material or rear cover 14, a supplemental piece of flat backing material or front cover 12, and a spine 16 coupling the pieces of backing material 12, 14 together. In the illustrated embodiment, the spine 16 functions as a flexible hinge that is pivotally coupled to the pieces backing material 12, 14. However, a binding mechanism may be used in place of or in addition to the spine 16 to couple the pieces of backing material 12, 14 together. The binding mechanism can take any of a variety of forms, including but not limited to a coil binding mechanism, spiral binding mechanism, three ring binder, adhesive binding, etc. The pieces of backing material 12, 14 and spine 16 may be made from plastic, cardboard, tweeds, faux leathers, silks, cottons or the like.

As shown in FIG. 1, various size notepads 30, 50, 55, 60, 65, 70 may be removably mounted to the piece of backing material 14 of the notepad system 10. The various-sized notepads 30, 50, 55, 60, 65, 70 may be located immediately adjacent to each other to define a recognizable shape. The recognizable shape formed by the notepads 30, 50, 55, 60, 65, 70 may be a geometric shape, such as a rectangle (which includes a square), ellipse (which includes a circle), triangle, octagon, hexagon, trapezoid, pentagon, etc. More particularly, the recognizable shape formed by the notepads 30, 50, 55, 60, 65, 70 may define generally a rectangular shape.

Figure 2:
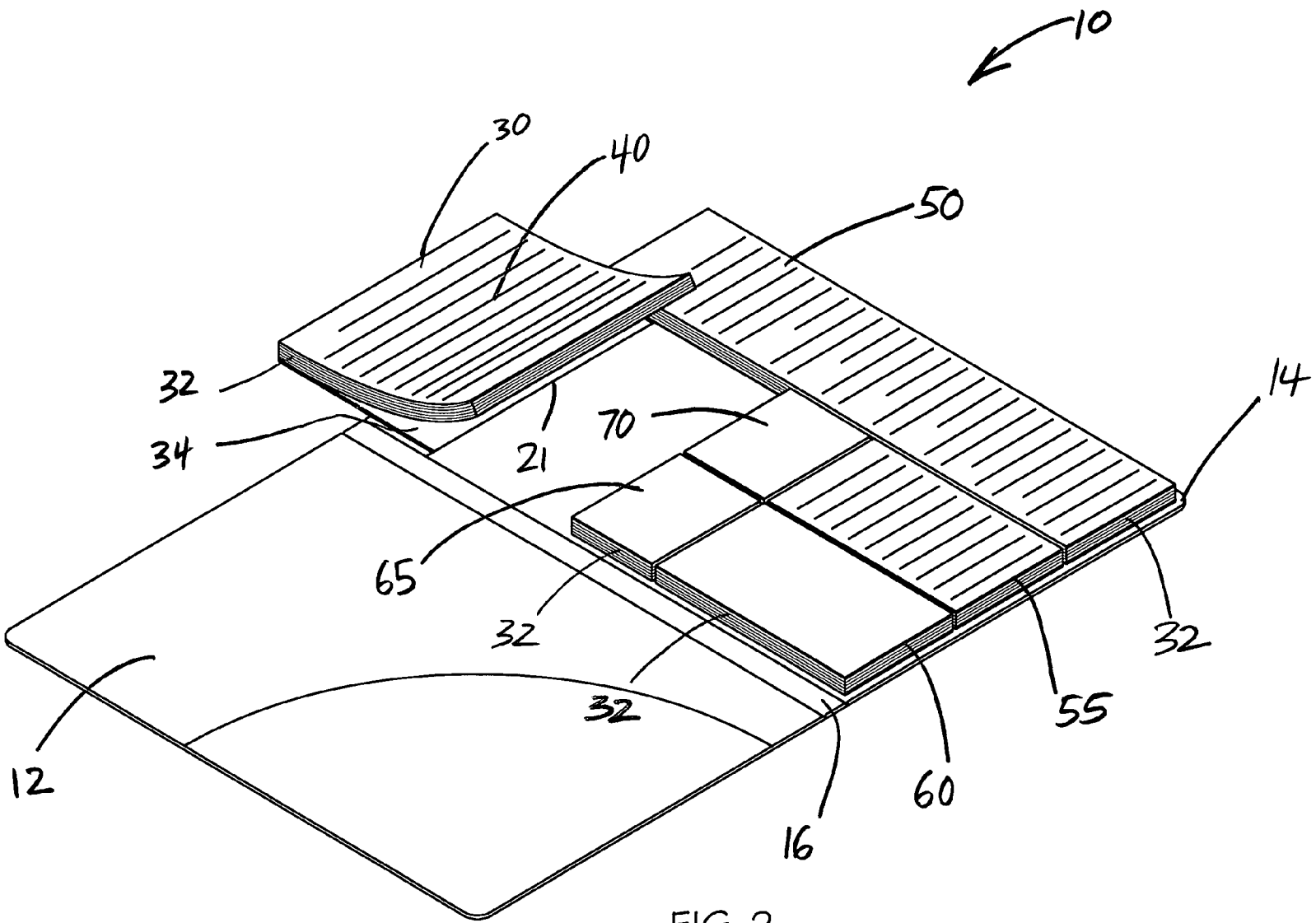
FIG. 2 is a side perspective view of the system of FIG. 1, showing a notepad being inserted through a slit on the backing panel.

As shown in FIG. 2, each notepad 30, 50, 55, 60, 65, 70 includes a stack of sheets of paper 32 and a backing sheet 34 which may be secured together by a releasable adhesive. Each sheet 32 may be made of a generally water absorbent material such as cellulose or pulp-based paper to allow a user to write thereon with a wide variety of writing instruments, including pen, pencil, marker and the like. Each backing sheet 34 has a stiffness or thickness that is greater than each sheet 32 of the associated notepad 30, 50, 55, 60, 65, 70 and can be made of cardboard, paperboard, plastic and the like.

Each sheet 32 may have an adhesive on its lower surface. For example, each notepad 30, 50, 55, 60, 65, 70 may be a stack of POST-IT® notes sold commercially by 3M Company of St. Paul, Minn. However, the sheets 32 need not necessarily include adhesive, and could instead be standard sheets of paper.

The piece of backing material 14 may include various mounting slits 20, 21, 22, 23, 24 which are sized to receive the backing sheet 34 of the notepads 30, 50, 55, 60, 65, 70 therein. For example, as shown in FIG. 2, the piece of backing material 14 may be a two-ply structure, where the backing sheet 34 of notepad 30 can be inserted through the slit 21 formed in the outer ply of the piece of backing material 14. The sheets (i.e., 40) can be written upon by the user and separated from the pad (i.e., 30) and then adhered to or placed on a desired surface.

Figure 3:
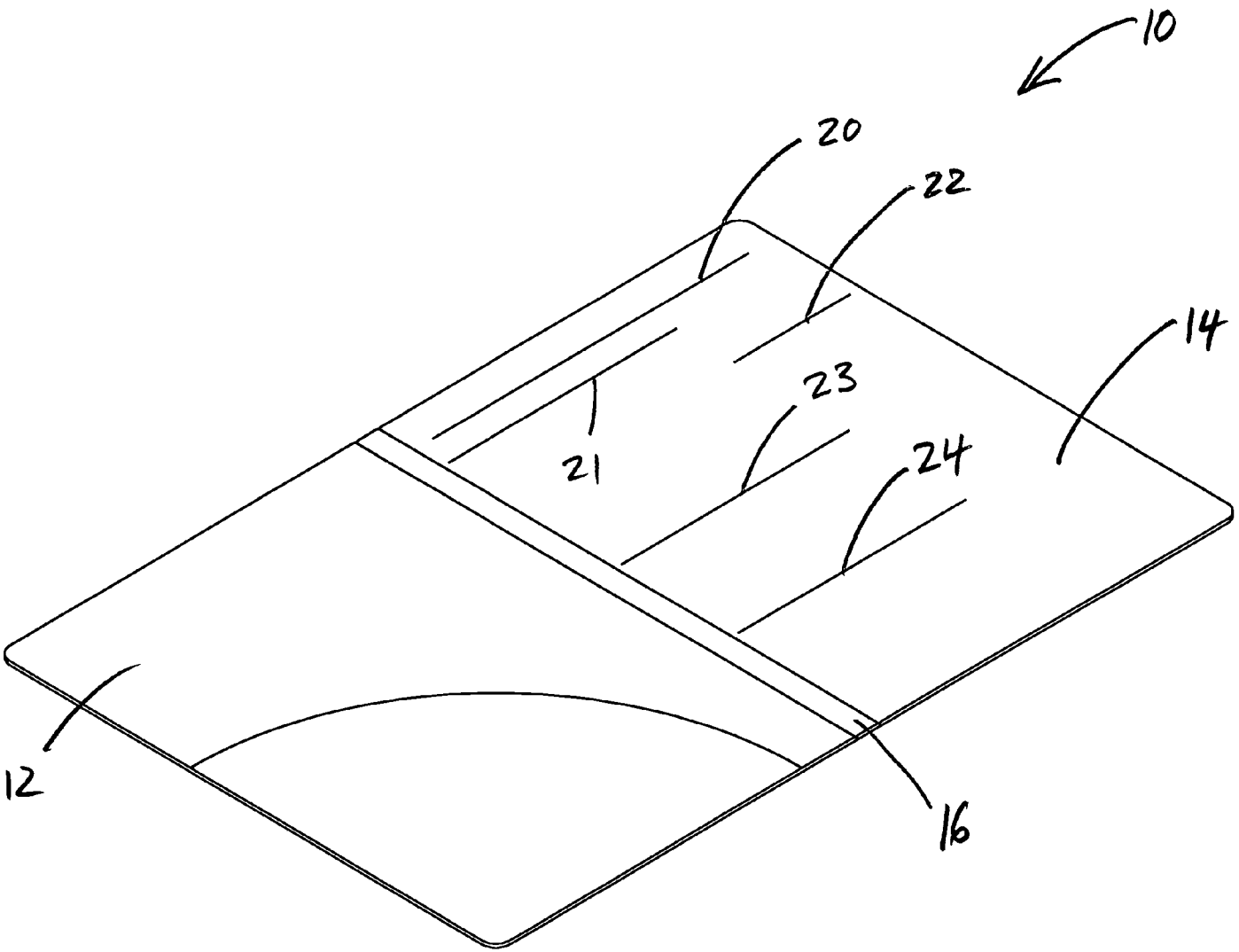
FIG. 3 is a side perspective view of the notepad system of FIG. 2, with all of the notepads removed.

As shown in FIG. 3, mounting slit 23 extends across at least 50% of the width of the piece of backing material 14 and is configured to removably receive both notepads 65, 70. Likewise, mounting slit 24 extends across at least 50% of the width of the piece of backing material 14 and is configured to removably receive both notepads 55, 60.

Figure 7:
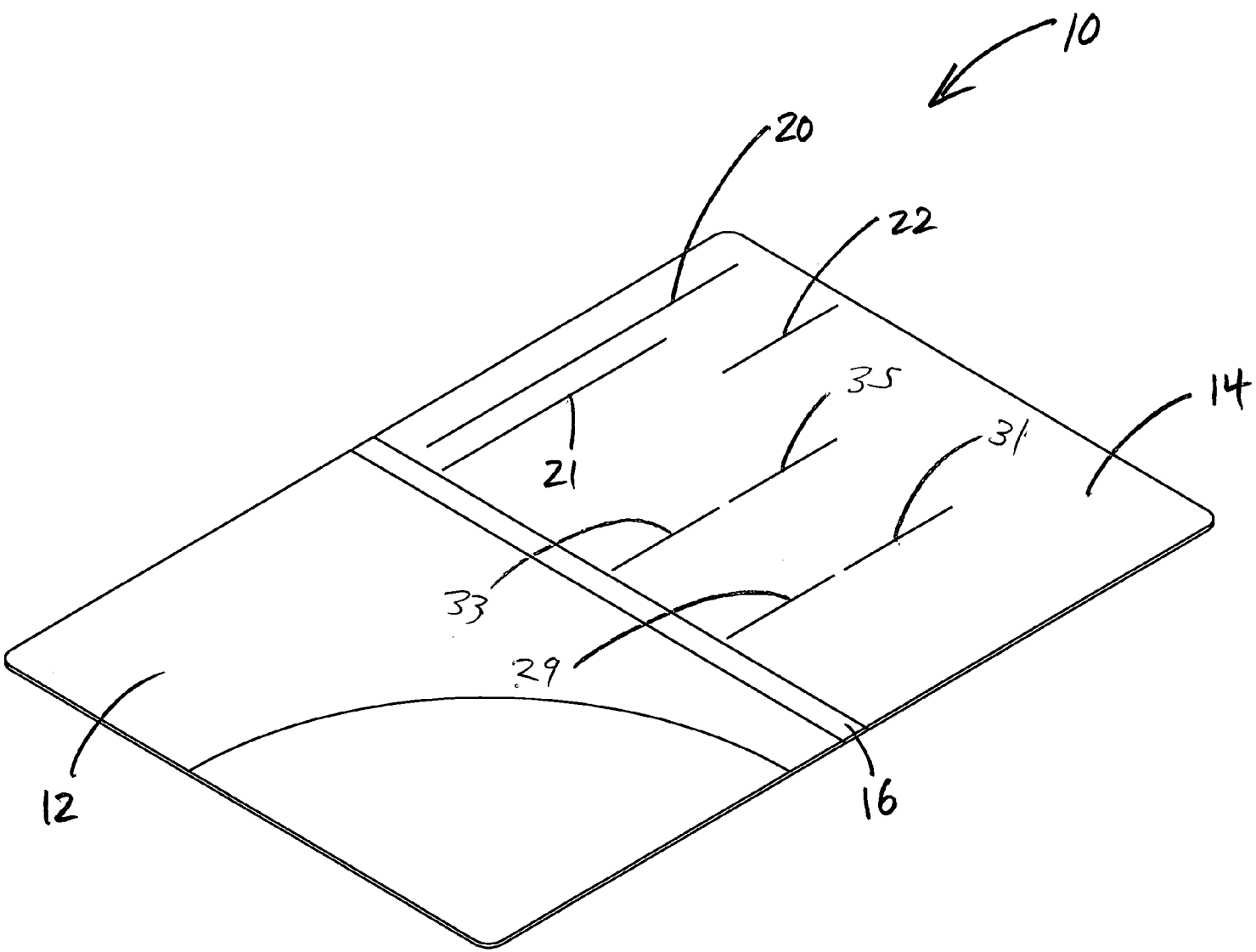
FIG. 7 is a side perspective view of an alternate embodiment of the notepad of FIG. 2, with all of the notepads removed.

Alternatively, as shown in FIG. 7, two separate slits 29, 31 may be used in place of the single slit 24. Slit 29 may be configured to receive the backing sheet 34 of notepad 60, and slit 31 may be configured to receive the backing sheet 34 of notepad 55. Likewise, two separate slits 33, 35 may be used in place of the single slit 23. Slit 33 may be configured to receive the backing sheet 34 of notepad 65, and slit 35 may be configured to receive the backing sheet 34 of notepad 70. The mounting slits 29, 31 are configured to be separated by a distance less than about ¼ inch, and more particularly less than about ⅛ inch, and most particularly to extend across at least 20% of the width of the piece of backing material 14. Likewise, mounting slits 33, 35 are configured to be separated by a distance less than about ¼ inch, and more particularly less than about ⅛ inch, and most particularly to extend across at least 20% of the width of the piece of backing material 14. The separation distance provides sufficient exposure for the notepads 65, 70 and notepads 55, 60 to be individually grasped by the user and removed from or replaced with another notepad on the piece of backing material 14.

In one embodiment of this invention, notepad 30 may be located a generally uniform spacing distance (i.e., in the left-to-right direction of FIG. 1) from adjacent notepad 50. Likewise, notepad 30 may be located a generally uniform spacing distance (i.e., in the vertical direction of FIG. 1) from adjacent notepads 65, 70. The generally uniform spacing distance is less than about 0.50 inches, or more particularly less than 0.25 inches, or yet more particularly less than 1/10 of an inch, or even more particularly less than about 1/10 of the smallest length or width dimension of notepads 65, 70. In another embodiment of this invention, when the rear cover 14 includes slits 20, 21, 22, 29, 31, 33, 35 as shown in FIG. 7, the generally uniform spacing distance (i.e., in the vertical direction and in the left-to right direction of FIG. 1) between adjacent notepads 30, 50, 55, 60, 65, 70 is less than about 0.50 inches, or more particularly less than 0.25 inches, or even more particularly less than about 1/10 of the smallest length or width dimension of notepads 65, 70.

As shown in FIG. 1, each notepad 30, 50, 55, 60, 65, 70 may have at least one outer edge that is generally aligned with an outer edge of at least one adjacent notepad. Furthermore, each notepad 30, 50, 55, 60, 65, 70 may have at least two outer edges, wherein each of the two outer edges are aligned with an outer edge of at least one adjacent notepad. In one embodiment of this invention as shown in FIG. 1, the rear cover 14 is configured to removably receive various sized notepads 30, 50, 55, 60, 65, 70 thereon such that the various sized notepads 30, 50, 55, 60, 65, 70 cover at least about 90% of a surface area of the rear cover 14.

The notepad system 10 may include at least two notepads 30, 50, 55, 60, 65, 70 of a different size and shape. For example, notepad 50 is a relatively long and thin notepad which can be used for grocery lists or the like. Notepads 65, 70 are relatively small and may be used for brief notes or reminders. The system 10 may also include at least two notepads of the same sizes (i.e., notepads 65, 70 and notepads 55, 60). More particularly, the system 10 may include four different sized notepads and six notepads in total which cover at least about 95%, or at least about 90% of the surface area of the piece of backing material 14.

As shown in FIG. 1, when differently sized notepads are used at least two different width dimensions (i.e., in the left-to-right direction of FIG. 1) may be available for the notepads 30, 50, 55, 60, 65, 70. In one embodiment of this invention, the largest width of any of the notepads is approximately double the smallest width of any of the notepads. Furthermore, the notepads may have varying height dimensions (i.e., in the vertical direction of FIG. 1), wherein the largest height dimension of any of the notepads is approximately five times greater than the smallest height of any of the notepads. The count of different width notepads, the count of different height notepads and the different ratios of width and height notepads may be varied as desired within the dimensional limits of the piece of backing material 14. Of course, the size and arrangement of slits may need to be adjusted accordingly.

The total count of notepads mounted upon the piece of backing material 14 may be varied as desired. The plurality of notepads may include at least three notepads, and more particularly at least four notepads, and even more particularly at least five notepads. All or some of the pads (e.g., pads 30, 50, 55 in the illustrated embodiment) may be lined to guide the writing of a user thereon.

Figure 4:
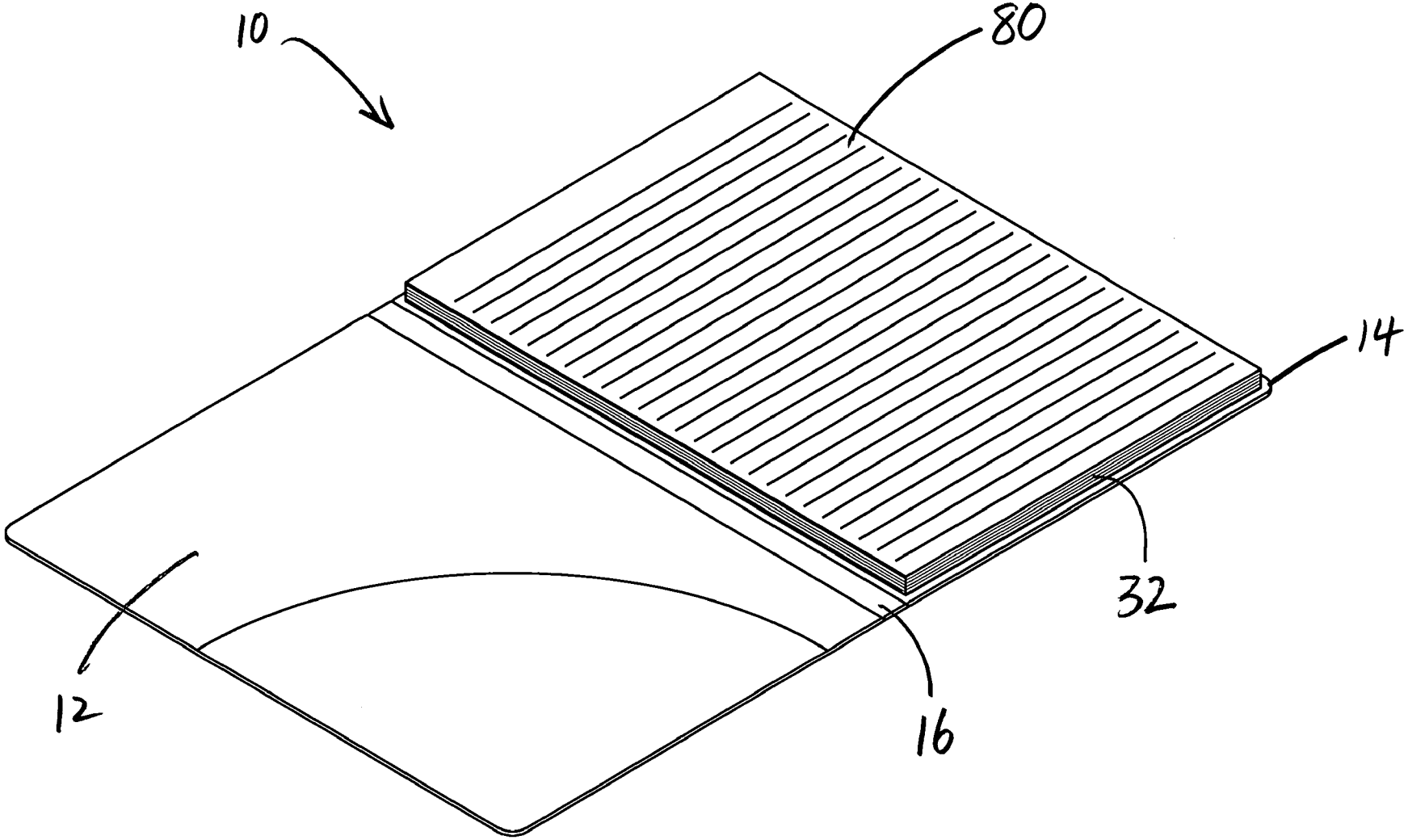
FIG. 4 is a side perspective view of the notepad system of FIG. 3, showing a single, larger notepad mounted onto the backing panel.

As shown in FIG. 3, the piece of backing material 14 may include a large mounting slit 20 which extends across at least about 90% of the width of the piece of backing material 14 and is configured to removably receive a large notepad 80. As shown in FIG. 4, when mounted to the piece of backing material 14 the large notepad 80 covers at least about 90% of the surface area of the piece of backing material 14. Thus, when the use of a single, larger notepad is required, the notepad 80 can be used in place of the smaller notepads 30, 50, 55, 60, 65, 70. This allows a user the ability to configure the system 10 as desired.

Figure 5:
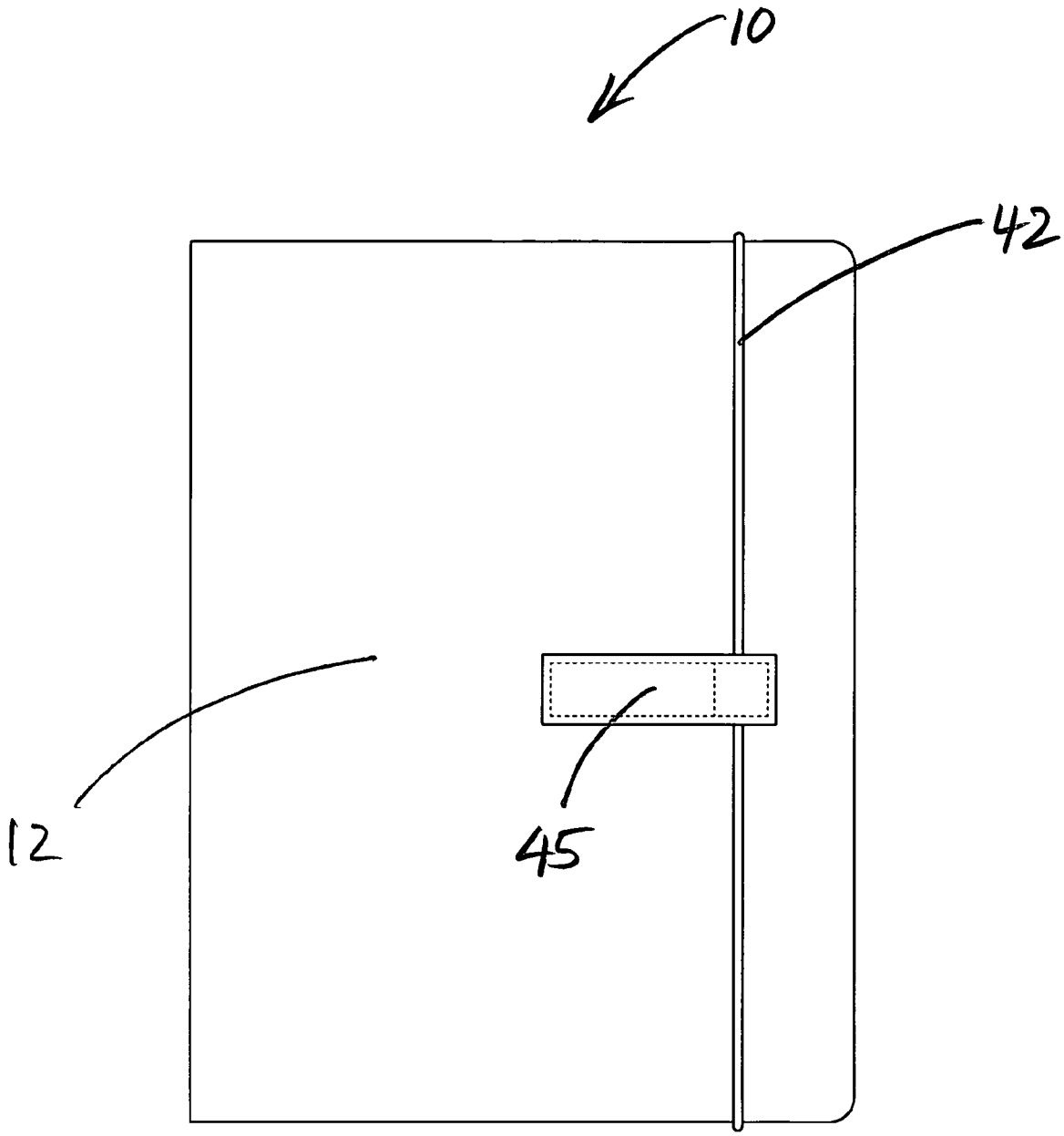
FIG. 5 is a top view of the notepad system of FIG. 1 moved to its closed position and with the retaining mechanism securing the notepad system in the closed position.

In another embodiment of the invention, the notepad system 10 further includes a retaining mechanism 42 configured to selectively circumscribe the front cover 12 and rear cover 14 to secure said notepad system 10 in a closed position. For example as shown in FIG. 5, in one embodiment the retaining mechanism 42 is an elastic strap 42 which can be expanded and passed around the front cover 12 and the rear cover 14 to secure the notepad system 10 in its closed position. However, the retaining mechanism 42 can take any of a variety of forms including but not limited to extensible strap, non-extensible strap, hook and loop retaining mechanisms, mechanical snaps, magnets, releasable adhesives, buttons, and ribbons. Furthermore, the retaining mechanism 42 can be made of a solid material that is not stretchable. For example, rather than being made of an elastic material, the retaining mechanism 42 may be made of paper, plastic, fabric, metal or the like.

As shown in FIG. 5, in one embodiment of the invention, the elastic strap 42 may be secured to the front cover 12 by a stitched clasp 45. The elastic strap 42 may be made of a generally stretchable solid material such as natural rubber, synthetic rubber, elastomeric plastic, elastomeric woven or braided fabric containing elastic fibers or the like that maybe extended when stretching forces are applied, and will sustain this extended shape while securing the notepad system 10 in its closed position, but will recover its original shape when the stretching forces are removed. Other representative examples of retaining mechanisms 42 for the front cover 12 and rear cover 14 include hook and loop fastening material (i.e., VELCRO®), mechanical snaps, etc.

In order to utilize the notepad system 10, a user would first move the notepad system 10 into an open position as shown in FIG. 1. Next, the user selects a notepad (e.g., notepad 30 may be used for a list of grocery items), and writes information on the topmost slip 40. The slip 40 can be removed from the pad 30 and then adhered to or placed on a desired surface or simply retained by the user (e.g., placed in a pocket). The user then moves the notepad system 10 into a closed position as shown in FIG. 5 and the elastic strap can be expanded and passed around the front cover 12 and rear cover 14 to secure the notepad system 10 in its closed position.

Figure 6:
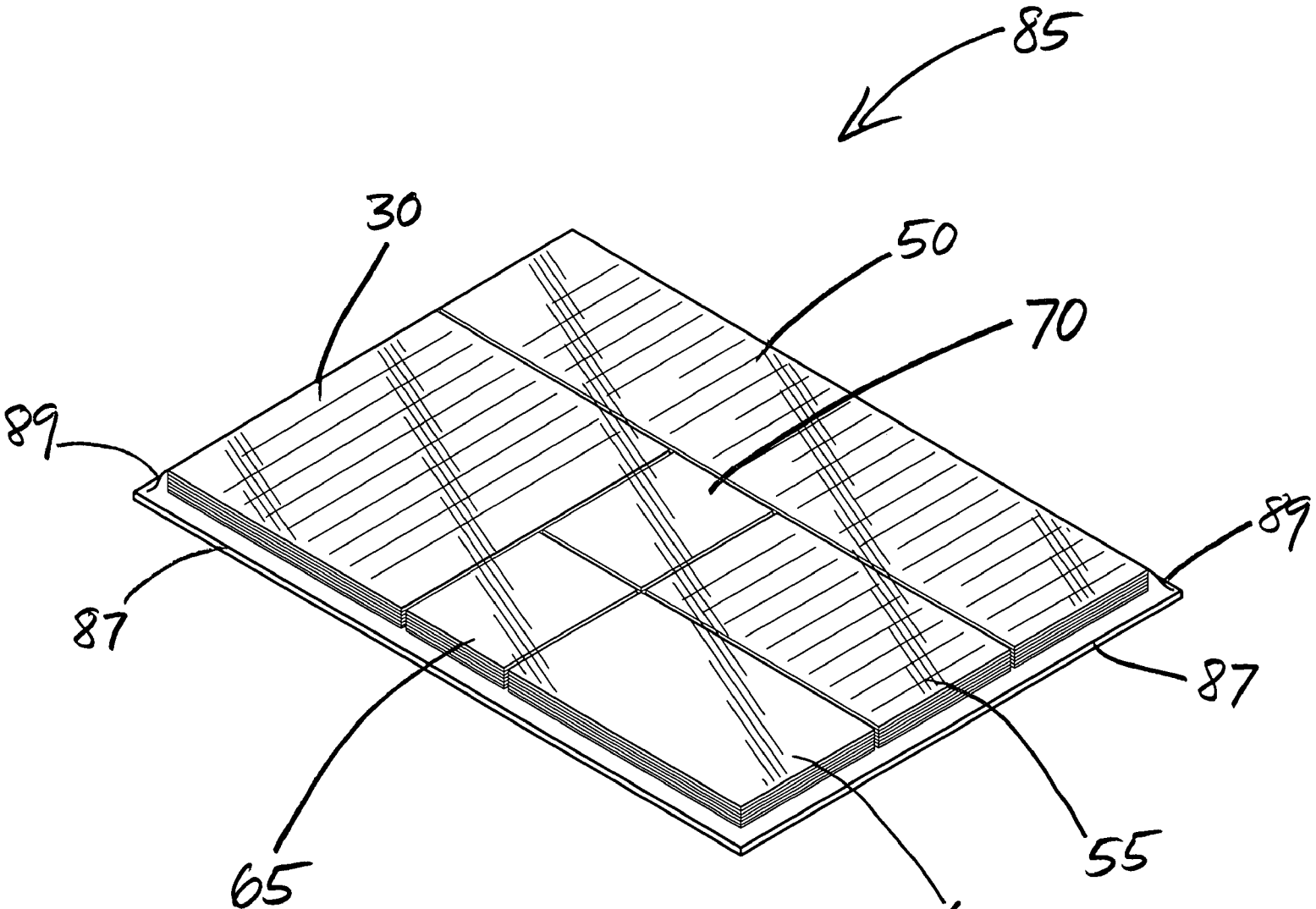
FIG. 6 is a front perspective view of a refill panel for the system of FIG. 1.

As shown in FIG. 6, a notepad refill system, generally designated 85, contains replenishment notepads 30, 50, 55, 60, 65, 70 in the appropriate sizes. The refill system 85 includes a backing panel 87 for supporting the notepads 30, 50, 55, 60, 65, 70 thereon. The backing panel 87 may have about the same size and shape as the rear cover 14, and the notepads 30, 50, 55, 60, 65, 70 may be arranged on the backing panel 87 in the same configuration in which the notepads will be located on the rear cover 14. Each of the notepads 30, 50, 55, 60, 65, 70 and backing panel 87 may be wrapped with a translucent plastic film 89 for tamper resistance and transport purpose.

The notepad refill system 85 provides a complete refill set of pads 30, 50, 55, 60, 65, 70 in the proper configuration. In this manner a user can easily replenish the pads in the notepad system 10 as needed. Each of the pads 30, 50, 55, 60, 65, 70 may be loosely placed on the backing panel 87, and held in place by the wrapping material 89. Alternatively, the backing panel 87 may be a two-ply structure having slits 20, 21, 22, 23, 24 formed in the outer-ply, as shown in FIG. 3, in which case the wrapping material 89 may not be needed.

Although the invention is shown and described with respect to certain aspects, modifications may occur to those skilled in the art upon reading the specification. The notepad system for holding and dispensing various sized notepads includes all such modifications and is limited only by the scope of the claims.

What is claimed is:

1. A notepad system comprising:

a piece of generally flat backing material; and a plurality of generally rectangular notepads removably mounted to said piece of backing material, said plurality of notepads being arranged in a generally planar side-by-side configuration and located immediately adjacent to each other to define a rectangle having an outer perimeter, and wherein outer-most edges of outer-most ones of said notepads generally define said outer perimeter of said rectangle, and wherein an outer-most edge of each outer-most notepad is generally aligned with an outer-most edge of an adjacent outer-most notepad such that said outer perimeter is generally straight and continuous, and wherein each notepad is generally equally spaced from each adjacent notepad, and wherein each notepad is spaced apart a uniform distance of less than 1/10 of an inch from any adjacent notepad, and wherein said rectangle covers substantially all the surface area of said piece of backing material, and wherein each notepad has a piece of notepad backing material having at least one of a stiffness or a thickness that is greater than each sheet of the associated notepad, and wherein said piece of backing material includes a plurality of slits formed therein, and wherein the notepad backing of each notepad is receivable through one of said slits to removably mount each notepad to said piece of backing material.

2. The notepad system of claim 1 wherein at least two of said notepads have a different size and shape.

3. The notepad system of claim 1 wherein at least two of said notepads have generally the same size and shape.

4. The notepad system of claim 1 wherein said plurality of notepads includes at least three notepads.

5. The notepad system of claim 1 wherein said plurality of notepads includes at least five notepads.

6. The notepad system of claim 1 wherein each notepad has at least two outer edges, each of the two outer edges being aligned with an outer edge of at least one adjacent notepad.

7. The notepad system of claim 1 wherein said piece of backing material has a size and shape generally corresponding to said plurality of notepads.

8. The notepad system of claim 1 wherein each notepad includes a plurality of sheets, each of which has an adhesive located on an underside thereof.

9. The notepad system of claim 1 further comprising a supplemental piece of generally flat backing material having about the same size and shape as said piece of backing material, and wherein said supplemental piece of backing material is pivotally coupled to said piece of backing material and movable to a closed position wherein said plurality of notepads are located generally between said piece of backing material and said supplemental piece of backing material.

10. The notepad system of claim 1 wherein said piece of backing material is a two-ply material, and wherein each slit is a cut formed through one ply of said two-ply material.

11. The notepad system of claim 1 wherein at least one slit is configured to receive a notepad backing of two notepads therethrough to removably mount said two notepads to said piece of backing material in a side-by-side configuration.

12. The notepad system of claim 1 wherein one of said plurality of notepads has a width about double the width of another one of said notepads.

13. A notepad system comprising:

a piece of generally flat backing material; and a plurality of generally rectangular notepads removably mounted to said piece of backing material, said plurality of notepads being arranged in a generally planar side-by-side configuration and located immediately adjacent to each other to define a rectangle having an outer perimeter, and wherein outer-most edges of outer-most ones of said notepads generally define said outer perimeter of said rectangle, and wherein an outer-most edge of each outer-most notepad is generally aligned with an outer-most edge of an adjacent outer-most notepad such that said outer perimeter is generally straight and continuous, and wherein each notepad is generally equally spaced from each adjacent notepad, and wherein each notepad is spaced apart a uniform distance of less than 1/10 of an inch from any adjacent notepad, and wherein said rectangle covers substantially all the surface area of said piece of backing material, and wherein said piece of backing material is configured to removably receive a large notepad thereon such that said large notepad covers at least about 90% of a surface area of said piece of backing material, and wherein said piece of backing material includes a mounting slit extending across at least about 90% of an outer dimension of said piece of backing material.

14. The notepad system of claim 13 further comprising said large notepad removably attachable to said piece of backing material, wherein said large notepad covers at least about 90% of a surface area of said piece of backing material.

15. A notepad system comprising:

a piece of generally flat backing material; and a plurality of generally rectangular notepads removably mounted to said piece of backing material, said plurality of notepads being arranged in a generally planar side-by-side configuration and located immediately adjacent to each other to define a rectangle having an outer perimeter, and wherein outer-most edges of outer-most ones of said notepads generally define said outer perimeter of said rectangle, and wherein an outer-most edge of each outer-most notepad is generally aligned with an outer-most edge of an adjacent outer-most notepad such that said outer perimeter is generally straight and continuous, and wherein each notepad is generally equally spaced from each adjacent notepad, and wherein each notepad is spaced apart a uniform distance of less than 1/10 of an inch from any adjacent notepad, and wherein said rectangle covers substantially all the surface area of said piece of backing material, and wherein said plurality of notepads includes at least one inner notepad, and wherein said at least one inner notepad is not one of said outer-most notepads and is located inside of, and entirely spaced away from, said outer perimeter of said rectangle formed by said plurality of notepads.

16. The notepad system of claim 15 wherein at least two of said notepads have a different size and shape.

17. The notepad system of claim 15 wherein at least two of said notepads have generally the same size and shape.

18. The notepad system of claim 15 wherein said plurality of notepads includes at least three notepads.

19. The notepad system of claim 15 wherein said plurality of notepads includes at least five notepads.

20. The notepad system of claim 15 wherein said piece of backing material has a size and shape generally corresponding to said plurality of notepads.

21. The notepad system of claim 15 wherein each notepad includes a plurality of sheets, each of which has an adhesive located on an underside thereof.

22. The notepad system of claim 15 further comprising a supplemental piece of generally flat backing material having about the same size and shape as said piece of backing material, and wherein said supplemental piece of backing material is pivotally coupled to said piece of backing material and movable to a closed position wherein said plurality of notepads are located generally between said piece of backing material and said supplemental piece of backing material.

23. A notepad system comprising: a piece of generally flat backing material; and a plurality of generally rectangular notepads removably mounted to said piece of backing material, said plurality of notepads being arranged in a generally planar side-by-side configuration and located immediately adjacent to each other to define a rectangle having an outer perimeter, and wherein outer-most edges of outer-most ones of said notepads generally define said outer perimeter of said rectangle, and wherein an outer-most edge of each outer-most notepad is generally aligned with an outer-most edge of an adjacent outer-most notepad such that said outer perimeter is generally straight and continuous, and wherein each notepad is generally equally spaced from each adjacent notepad, wherein said piece of backing material includes a slit positioned and configured to removably receive a large notepad thereon such that said large notepad covers at least about 90% of a surface area of said piece of backing material when said plurality of generally rectangular notepads are removed from said backing material.

* * * * *